US008483583B2

(12) United States Patent
Takehara et al.

(10) Patent No.: US 8,483,583 B2
(45) Date of Patent: Jul. 9, 2013

(54) IMAGE FORMING APPARATUS AND TONER SUPPLY METHOD

(75) Inventors: Atsushi Takehara, Kyoto (JP); Naoki Nakatake, Hyogo (JP); Tetsumaru Fujita, Hyogo (JP); Tomohiro Kubota, Osaka (JP); Kohta Sakaya, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 13/025,266

(22) Filed: Feb. 11, 2011

(65) Prior Publication Data

US 2011/0217055 A1 Sep. 8, 2011

(30) Foreign Application Priority Data

Mar. 5, 2010 (JP) ..... 2010-049004

(51) Int. Cl.
*G03G 15/08* (2006.01)

(52) U.S. Cl.
USPC ..... 399/29; 399/27

(58) Field of Classification Search
USPC ..... 399/27, 29, 60
See application file for complete search history.

(56) References Cited

U.S. PATENT DOCUMENTS

2006/0198644 A1* 9/2006 Itagaki et al. ..... 399/27
2008/0075480 A1 3/2008 Konishi et al.
2010/0098441 A1 4/2010 Miyazaki et al.

FOREIGN PATENT DOCUMENTS

JP 4026977 10/2007
JP 2009-75244 4/2009

OTHER PUBLICATIONS

Office Action issued Aug. 13, 2012, in Chinese Patent Application No. 201110105480.4 with English translation.
U.S. Appl. No. 13/020,405, filed Feb. 3, 2011, Nakatake, et al.

* cited by examiner

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

Toner is supplied from a toner container to a developing part that causes the toner to adhere to a latent image formed on a latent image carrying member and develops the latent image, a pre-toner-supply operation of supplying a predetermined amount of toner to the developing part is carried out, a fog detecting image is formed and fog is detected in the fog detecting image, a toner supply amount to be supplied to the developing part is determined based on the fog detected in the detecting and an operational status of the developing part since the toner was supplied to the developing part the last time, and the toner supply amount of the toner determined in the determining is supplied to the developing part.

10 Claims, 9 Drawing Sheets

IMAGE FORMING APPARATUS AND TONER SUPPLY METHOD

BACKGROUND OF THE INVENTION

1. Field of the Invention

The present invention relates to an image forming apparatus and a toner supply method.

2. Description of the Related Art

In the related art, a single-component developing apparatus is known. In the single-component developing apparatus, developing is carried out in such a manner that a developing roller, which is a toner carrying member, carries toner that is developer of a non-magnetic or magnetic single component, and the toner on the developing roller is supplied to a latent image on a photosensitive member, in a developing area in which the photosensitive member that is a latent image carrying member and the developing roller face one another.

In the single-component developing apparatus, the developing apparatus is replaced when the toner in the developing apparatus has run out. Therefore, the developing roller for which a replacement time has not been reached yet and thus usage of which can be continued is also replaced. Thus, a resource may be wasted. In a case where the developing apparatus is configured such that a time at which the toner in the developing apparatus runs out and the replacement time of the developing roller and so forth are the same as one another, it may be necessary to ensure a space for holding a great amount of toner in the developing apparatus, and thus, the developing apparatus may be increased in size.

Japanese Patent No. 4026977 (patent document 1) describes an image forming apparatus in which a toner container that holds toner is provided separate from a developing apparatus, and a supplying part supplies the toner of the toner container to the developing apparatus. Thereby, in a case where the toner in the toner container has run out, only the toner container is to be replaced, and thus, a developing roller for which usage can be continued is not to be replaced. Further, because an amount of new toner to be held by the toner container may be determined without regard to a replacement time of the developing roller, it is possible to reduce a capacity of the toner container to be small, and thus, it is possible to prevent the image forming apparatus from being increased in size.

Further, according to the image forming apparatus of the patent document 1, the toner of the toner container is supplied to the developing apparatus when the toner amount in the developing apparatus becomes less than a lower limit value. Therefore, after the toner is thus supplied to the developing apparatus, the toner newly supplied from the toner container and old toner having remained in the developing apparatus for a long period of time without being used for developing are mixed together.

Japanese Laid-Open Patent Application No. 2009-75244 (patent document 2) describes the following image forming apparatus for preventing fog caused as a result of new toner being supplied to a developing apparatus in which old deteriorated toner remains. The term "fog" means a phenomenon that an image area that is to be a blank has a density increased as a result of toner adhering thereto through a developing process. That is, when a toner amount in the developing apparatus becomes less than a lower limit value, such control is carried out that, before toner is supplied to the developing apparatus, the toner remaining in the developing apparatus is ejected toward a photosensitive member. Thereby, the old toner remaining in the developing apparatus is ejected to the photosensitive member, and, in a condition in which the developing apparatus has thus become approximately empty of toner, new toner is supplied from a toner container. Therefore, almost all of the toner in the developing apparatus becomes the new toner after the new toner is thus supplied, and thus, it is possible to prevent fog after the new toner is supplied.

However, according to the above-mentioned patent document 2, the old toner remaining in the developing apparatus is ejected to the photosensitive member, and thus, is discarded. As a result, the toner may be wasted.

A reason why fog occurs when deteriorated old toner and new toner are mixed will now be described concretely.

Old toner remaining in a developing apparatus has suffered stress for a long period of time due to such as stirring. As a result, an external additive that is added externally to surfaces of toner particles for controlling flowability and an electrification property may have been removed or may have been embedded in the particles. Thereby, the toner may not be easily electrified frictionally to, for example, negative polarity that is normal electrification polarity of the toner. On the other hand, new toner supplied to the developing apparatus is not deteriorated and thus, is easily electrified frictionally to the negative polarity. Therefore, when the new toner that is easily electrified to the negative polarity and the old toner that is not easily electrified to the negative polarity are rubbed together, charge separation occurs, and electrons in the old toner move to the new toner. As a result, an electrification amount of the new toner having the negative polarity may increase, an electrification amount of the old toner having the negative polarity may decrease, or the old toner may be electrified to have positive polarity. As a result, the toner electrification distribution in the developing apparatus becomes broad, and also, such a distribution may occur in which two peaks, i.e., an area in which the electrification amount to the negative polarity is large and an area in which the electrification amount is close to zero, exist. Thus, after the new toner is supplied, the deteriorated toner may become weak electrified toner, or reverse electrified toner. Therefore, in an image forming process after the new toner is supplied, the above-mentioned deteriorated old toner may adhere to an area (other than a latent image area) on a photosensitive member that is an image carrying member for which area no toner is desired to be placed. As a result, fog increases in comparison to a case before the new toner is supplied.

Such fog can be reduced by reducing a ratio of deteriorated old toner existing after new toner is supplied. Therefore, by increasing a new toner amount to be supplied, it is possible to reduce the ratio of deteriorated old toner in the developing apparatus without carrying out the above-mentioned process of ejecting the toner remaining in the developing apparatus, and thus, it is possible to reduce fog occurring after new toner is supplied without uselessly consuming the toner.

However, when the new toner amount to be supplied is increased, the toner amount in the developing apparatus increases, which may result in an increase in torque of a stirring member, toner packing or such. Therefore, it is necessary to reduce, as much as possible, the toner amount in the developing apparatus after new toner is supplied. If the remaining old toner amount in the developing apparatus can be precisely determined when new toner is supplied, it is possible to supply a minimum necessary amount of new toner to the developing apparatus such that fog occurring after the new toner is supplied can be made to be an allowable level, and it is possible to prevent the toner amount in the developing apparatus after the new toner is supplied from becoming larger than the necessary amount. The term "toner packing" means a phenomenon that toner solidifies, or a phenomenon that fluidity of toner remarkably degrades. Toner packing may occur as a result of toner being pressed at high pressure, and may result in an increase of a torque of a machine that processes the toner or a structure that passes the toner therethrough is clogged by the toner.

A remaining amount detecting part that detects a toner remaining amount in the developing apparatus in the related art is such that a piezoelectric sensor is provided in the developing apparatus and a remaining amount in the developing apparatus is detected by using an output of the piezoelectric sensor. Another example is such that a detecting window is provided to the developing apparatus, a transmission optical sensor is used to detect whether toner exists in the detecting window to detect a height of the toner in the developing apparatus, and a remaining amount is detected from the detected height of the toner in the developing apparatus. However, in the remaining amount detecting method of using the piezoelectric sensor, precise remaining amount detection may not be carried out when a deviation occurs in a toner amount between a place at which the piezoelectric sensor is provided and a place at which the piezoelectric sensor is not provided. Further, in the remaining amount detecting method of using the transmission optical sensor, precise remaining amount detection may not be carried out when a deviation occurs in a toner amount between a place at which the transmission optical sensor is provided and a place at which the transmission optical sensor is not provided. Thus, it may be difficult to precisely determine a toner remaining amount in the developing apparatus in the related art, and thus, it may not be possible to supply, based on a detection result of the remaining amount detecting part, a minimum necessary amount of new toner to the developing apparatus such that fog occurring after the new toner is supplied can be made to be an allowable level. Therefore, new toner may be supplied in an amount larger than the necessary amount, and thus, it may not be possible to sufficiently prevent an increase in torque of a rotating member such as a stirring member, toner packing, or such in the developing apparatus.

SUMMARY OF THE INVENTION

According to one embodiment of the present invention, an image forming apparatus includes a latent image carrying member that carries a latent image; an electrifying part that electrifies a surface of the latent image carrying member; a latent image writing part that writes the latent image on the latent image carrying member; a developing part that develops the latent image on the latent image carrying member by using toner and obtains a toner image; a transferring part that transfers the toner image on the latent image carrying member to a surface of an endless moving member in which the surface is moved in an endless manner or a recording member held on the surface of the endless moving member; a toner container that holds new toner to be supplied to the developing part; a toner supplying part that supplies the new toner held by the toner container to the developing part; a fog detecting part that detects fog of an image; and a toner supply amount determining part that, prior to supplying the new toner to the developing part, carries out a pre-toner-supply operation of supplying a predetermined amount of the new toner to the developing part, forms a fog detecting image after the pre-toner supply operation, detects fog in the fog detecting image by means of the fog detecting part, and determines a new toner supply amount to be supplied to the developing part based on a detection result obtained from the fog detecting part detecting fog in the fog detecting image and an operational status of the developing part since new toner was supplied to the developing part the last time, wherein the toner supplying part supplies the new toner supply amount of the new toner determined by the toner supply amount determining part to the developing part.

According to another embodiment of the present invention, a toner supply method of supplying toner from a toner container to a developing part that causes the toner to adhere to a latent image formed on a latent image carrying member and develops the latent image, includes carrying out a pre-toner-supply operation of supplying a predetermined amount of toner to the developing part; forming a fog detecting image and detecting fog in the fog detecting image; determining a toner supply amount to be supplied to the developing part based on the fog detected in the detecting and an operational status of the developing part since the toner was supplied to the developing part the last time; and supplying the toner supply amount of the toner determined in the determining to the developing part.

DETAILED DESCRIPTION OF THE EMBODIMENTS

An embodiment of the present invention has been devised in consideration of the above-mentioned problems, and an object of the embodiment of the present invention is to provide an image forming apparatus and a toner supply method in which it is possible to prevent useless toner consumption, prevent fog occurring after new toner is supplied, and also, prevent an increase in torque and toner packing in a developing apparatus or developing part.

Figure 1:
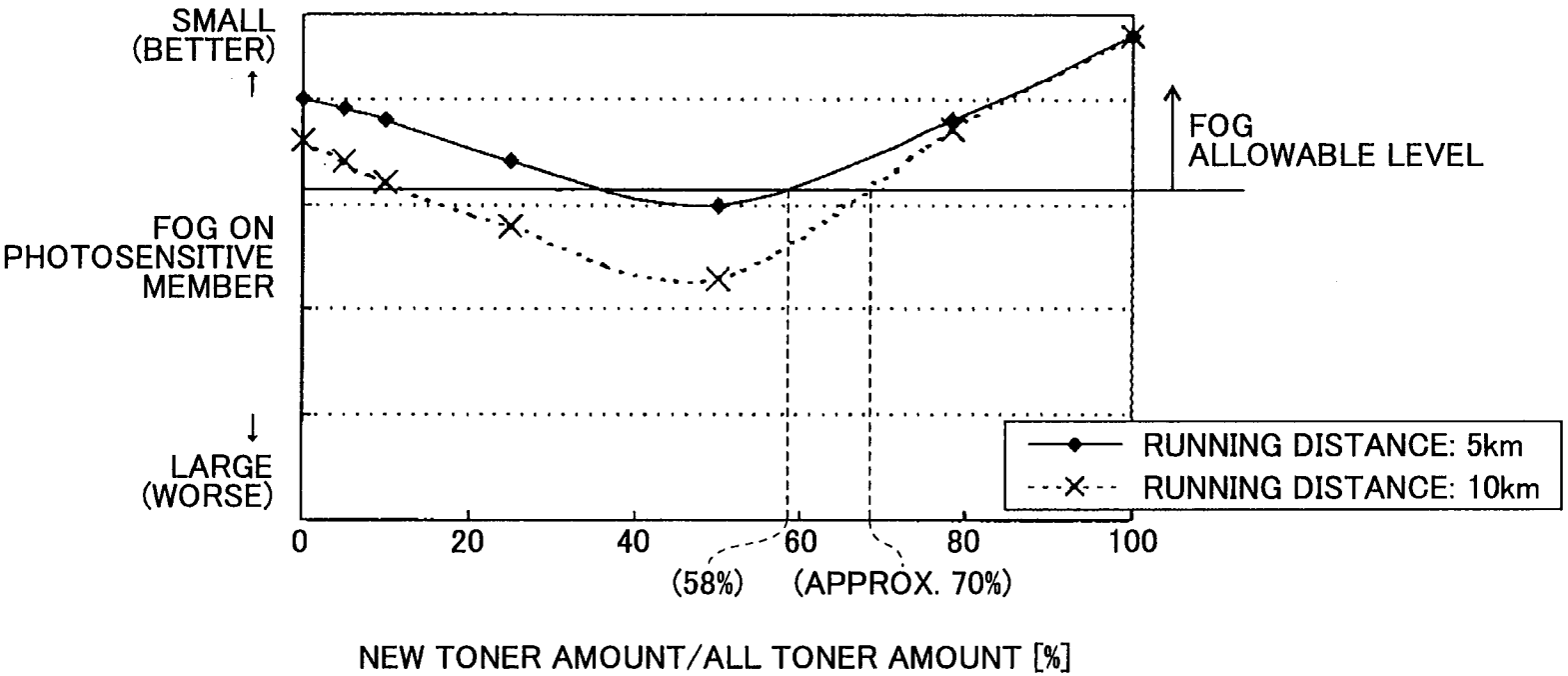
FIG. 1 is a graph showing a result of investigating a relationship between a ratio of new toner with respect to all the toner amount in a developing part and summing.

A relationship between a ratio of new toner with respect to all the toner amount in a developing part and fog was investigated, and it was found out that the relationship shown in FIG. 1 existed. The relationship between a ratio of new toner with respect to all the toner amount in the developing part and fog was investigated in a method described below. First, a developing part of a printer Ipsio C220 was filled with toner, and a durability test was carried out such that a running distance of a developing roller (outer perimeter×number of revolutions of the developing roller) at room temperature was 5 km and 10 km. After the durability tests, the toners were extracted from the developing part. The extracted toners were used as old toners remaining in the developing part and new toner was used as new toner to be supplied to the developing part, and mixed toners having mutually different mixing ratios of the old toner and the new toner were prepared. Then, by using the mixed toners having mutually different mixing ratios, blank paper images as fog detecting images were formed on a photosensitive member as a latent image carrying member, and toner amount levels (fog amounts) on the photosensitive member were measured. Thus, the relationship between a ratio of new toner with respect to all the toner amount in the developing part and fog was investigated. FIG. 1 shows the results. A broken line in FIG. 1 shows a relationship between a ratio of new toner with respect to all the toner amount in the developing part and fog in the case where the toner extracted after the durability test of the running distance of the developing roller of 10 km was used as the old toner. It is noted that in FIG. 1, for the sake of convenience, the upper direction denotes a direction in which the fog amount decreases, i.e., the fog situation becomes better, and the lower direction denotes a direction in which the fog amount increases, i.e., the fog situation becomes worse. A solid line in FIG. 1 shows a relationship between a ratio of new toner with respect to all the toner amount in the developing part and fog in the case where the toner extracted after the durability test of the running distance of the developing roller of 5 km was used as the old toner. As can be seen from FIG. 1, it is possible to determine a new toner amount with respect to all the toner amount in the developing part and an old toner amount with respect to all the toner amount in the developing part when an operational status of the developing part (i.e., a running distance of the developing roller in this example) and fog are determined.

Therefore, according to an embodiment of the present invention, an old toner amount remaining in a developing part is precisely determined by the following method. First, a pre-toner-supply operation is carried out, and thus, a predetermined amount of new toner is supplied to the developing part. Thereby, new toner having a certain ratio with respect to all the toner in the developing part exists. By using the developing part having this condition, a fog detecting image is formed, and fog is detected in the fog detecting image. Then, from a detection result of the fog being detected in the fog detecting image and the operational status of the developing part (the running distance of the developing roller), it is possible to determine the certain ratio of the new toner with respect to all the toner in the developing apparatus after the pre-toner-supply operation, as shown in FIG. 1. Because the new toner amount supplied to the developing part at the time of the pre-toner-supply operation is known, it is possible to precisely determine the old toner amount remaining in the developing part from the certain ratio of the new toner in the developing part obtained based on the fog detection result and the operational status, and the new toner amount supplied to the developing part at the time of pre-toner-supply operation.

Thus, it is possible to precisely determine the old toner amount in the developing part, and thus, it is possible to determine a new toner amount to be supplied to the developing part so that a ratio of new toner in the developing part becomes such an amount that fog can be made to be an allowable level. For example, as shown in FIG. 1, when the running distance of the developing roller as an operational status is 10 km, it is possible to make fog to be an allowable level by making the ratio of new toner to be equal to or more than approximately 70%. Therefore, new toner is to be supplied by an amount such that a ratio of new toner becomes equal to 70%. Further, when the running distance of the developing roller as an operational status is 5 km, it is possible to make fog to be an allowable level by making the ratio of new toner to be equal to or more than 58%. Therefore, new toner is to be supplied by an amount such that a ratio of new toner becomes equal to 58%. Thus, it is possible to supply new toner by a minimum necessary amount such that fog can be made to be an allowable level. Thus, it is possible to prevent a toner amount in the developing part from becoming excessive. As a result, it is possible to prevent an increase in torque and toner packing in the developing part. Further, because it is possible to make fog to be an allowable level without carrying out the above-mentioned process of ejecting the toner remaining in the developing part, it is possible to avoid useless toner consumption, and prevent fog after new toner is supplied.

Thus, according to the embodiment of the present invention, it is possible to avoid a waste of toner, avoid fog occurring after new toner is supplied, and also, avoid an increase in torque of a rotating member such as a stirring member and toner packing.

Below, an embodiment of an electrophotographic printer (simply referred to as a printer, hereinafter) as an image forming apparatus according to the present invention will now be described.

Figure 2A:
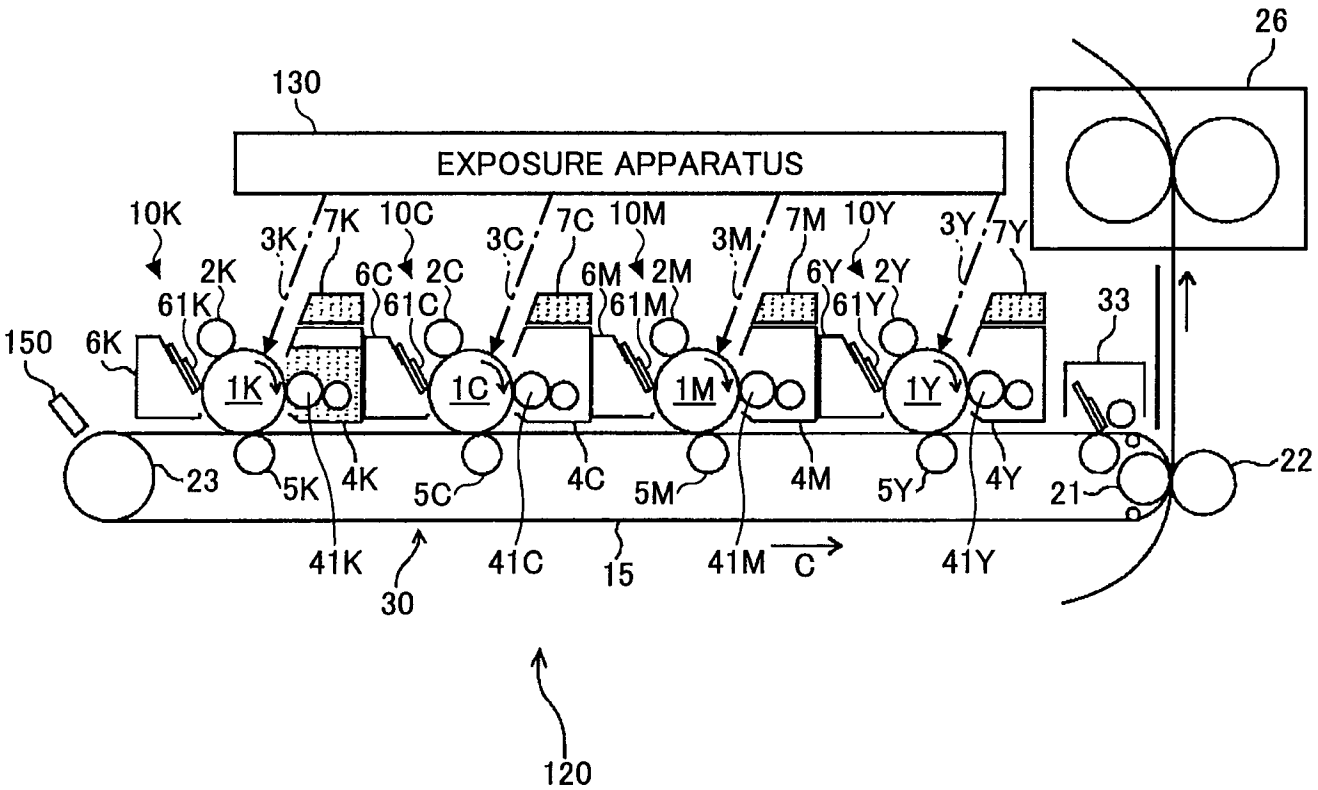
FIG. 2A shows a general partial configuration of a printer according to an embodiment of the present invention.
Figure 2B:
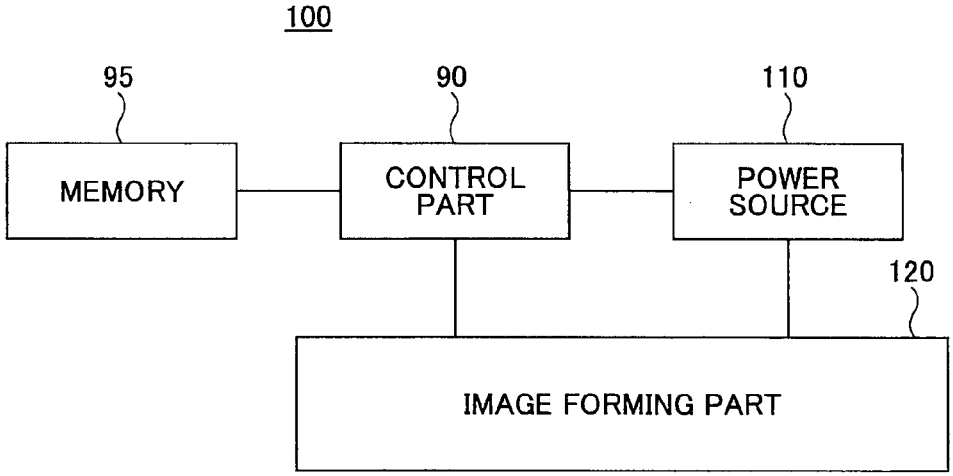
FIG. 2B shows a block diagram showing a relationship between a control part and a power source included in the printer and the image forming part shown in FIG. 2A.
Figure 3:
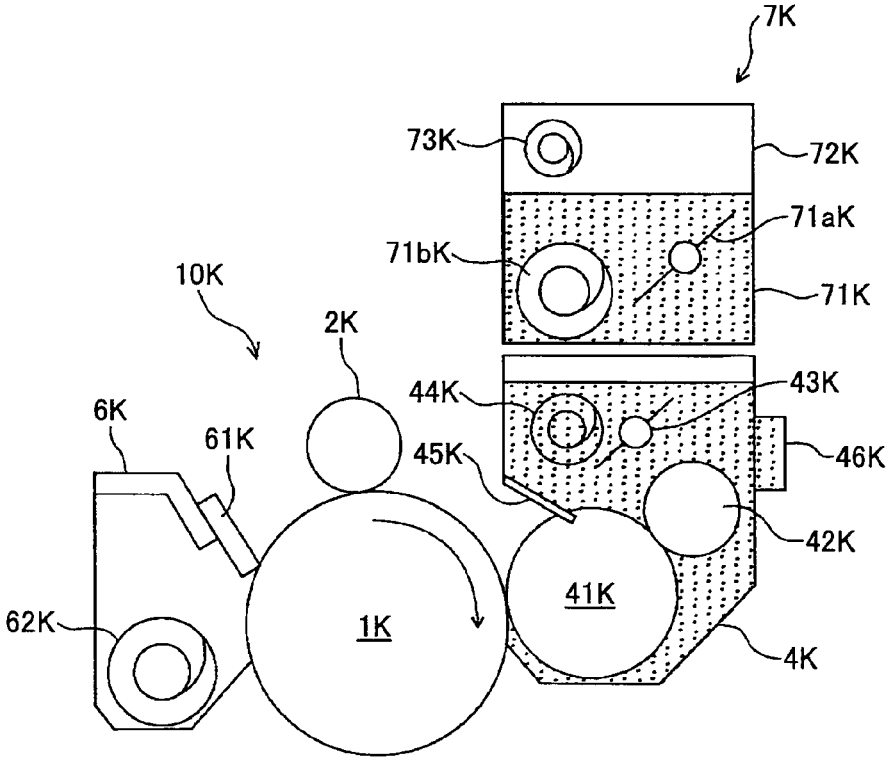
FIG. 3 shows a general configuration of a process cartridge for a color K (black) and parts around it in the printer shown in FIG. 2.

First, a basic configuration of a printer 100 will now be described. FIG. 2A shows a general partial configuration of an image forming part 120 of the printer 100. In FIG. 2A, the image forming part 120 of the printer 100 includes four process cartridges 10Y, 10M, 10C and 10K for forming yellow, magenta, cyan and black (simply referred to as Y, M, C and K, respectively, hereinafter) toner images, respectively. These four process cartridges 10Y, 10M, 10C and 10K use Y, M, C and K toners of mutually different colors, respectively. Other than this point, these four process cartridges 10Y, 10M, 10C and 10K have the same configurations as each other, and are replaced when they come to the ends of their lives, respectively. FIG. 2B shows a control part 90 and a power source 110 included in the printer 100. The control part 90 controls operations of various parts/components included in the image forming part 120 of the printer 100. The power source 110 supplies power to the various parts/components included in the image forming part 120 of the printer 100. To take the process cartridge 10K for forming a K toner image as an example, as shown in FIG. 3, the process cartridge 10A includes a drum-like photosensitive member 1K as a latent image carrying member, an electrifying apparatus 2K, a developing apparatus 4K and a drum cleaning apparatus 6K as a toner removing part. The process cartridge 10K is detachable from the body of the printer 100, and has such a configuration that consumable parts can be replaced at a time.

The electrifying apparatus 2K as an electrifying part is configured so that a high voltage of a metal core of an electrification roller (2K), which is in contact with a surface of the photosensitive member 1K and thus is rotated along with rotation of the photosensitive member 1K, is applied to the surface of the photosensitive member 1K, and the surface of the photosensitive member 1K is thus uniformly electrified. Instead of the electrification roller (2K) that is the electrifying part in a contact type, a corotron-type or a scorotron type electrification unit that discharges electricity as a result of a high voltage being applied to a charging wire, and further, an electrification brush, an electrification sheet, a stylus electrode, or such, may be used. These are advantageous in that they can electrify the surface of the photosensitive member 1K in a non-contact manner, and thus, are not easily affected by a cleaning property. However, an amount of discharge product such as ozone, NOx or such, generated along with discharging, is remarkably larger than that in the case of using the electrification roller, and therefore, a problem may arise concerning durability of the photosensitive member 1K.

The developing apparatus 4K is a single-component developing apparatus, and includes a developing roller 41K as a toner carrying member, and a toner supply roller 42K as a toner supply member that supplies toner to the developing roller 41K. Above the developing apparatus 4K, a toner container 7K is provided. In the toner container 7K are included a toner storage part 71K that stores new toner and a waste toner receiving part 72K that is provided above the toner storage part 71K and receives waste toner. In the toner storage part 71K are provided an agitator 71*a*K that is driven and rotated by a driving part not shown, and a conveying member 71*b*K that includes a screw or a coil and conveys the new toner from the inside of the toner storage part 71K toward a toner supply port not shown acting as a connection part connecting between the developing apparatus 4K and the toner storage part 71K. The conveying member 71*b*K is driven and rotated by a driving part not shown. It is preferable that the agitator 71*a*K is at any time driven and rotated to stir the new toner in the inside of the toner storage part 71K for the purpose of maintaining flowability of the new toner in the inside of the toner storage part 71K.

In the developing apparatus 4K are provided a toner transporting member 44K that includes a screw or such for conveying the new toner of the toner storage part 71K supplied from the toner supply port to the entire area in an axis direction of the developing apparatus 4K, an agitator 43K that stirs toner in the developing apparatus 4K, and the developing roller 41K that is the toner carrying member. Further, a lamellation blade 45K, an extending end of which is in contact with the developing roller 41K and which makes thinner a toner layer that is carried by the developing roller 41K, and the toner supply roller 42K that is in contact with the developing roller 41K and supplies toner to the developing roller 41K, are provided.

The toner supply roller 42K is in contact with the developing roller 41K, is rotated along with rotation of the developing roller 41K or is rotated in a rotation direction reverse or counter to a rotation direction of the developing roller 41K, and supplies toner that adheres to the toner supply roller 42K to the toner developing roller 41K. The surface of the toner supply roller 42K is coated by a formed material having cells, thus, efficiently takes in by causing the toner in the inside of the developing apparatus 4K to adhere to the formed material, and also, prevents deterioration of the toner otherwise occurring because of concentration of pressure at a part at which the toner supply roller 42K is in contact with the developing roller 41K. To the toner supply roller 42K, a voltage of normal electrification polarity (negative polarity) of toner is applied by the power source 110 as a voltage applying part. The voltage is a negative voltage lower than a voltage (negative voltage) applied to the developing roller 41K, that is, a negative voltage having an absolute value larger than an absolute value of the negative voltage applied to the developing roller 41K. Thereby, at the part at which the toner supply roller 42K is in contact with the developing roller 41K, an electric field is generated. Friction electrification of the toner in the inside of the developing apparatus 4K is promoted as the toner is stirred by the agitator 43K and the toner is electrified in the normal electrification polarity (negative polarity). Therefore, the toner held by the toner supply roller 42K and conveyed to the part at which the toner supply roller 42K is in contact with the developing roller 41K moves from the toner supply roller 42K to the developing roller 41K by the influence of the electric field, and statically adheres to the developing roller 41K. A layer thickness of the K toner adhering to the developing roller 41K on the surface of the developing roller 41K is controlled by the lamellation blade 45K when the K toner on the developing roller 41K passes a position along with rotation of the developing roller 41K at which the developing roller 41K is in contact with the lamellation blade 45K. The K toner, after the layer thickness thereof is thus controlled, adheres to an electrostatic latent image for the color K formed on the photosensitive member 1K for the color K at a developing area that is a part at which the developing roller 41K is in contact with the photosensitive member 1K. As a result of the adhesion, the electrostatic latent image for the color K is developed by the K toner into a K toner image.

Figure 4:
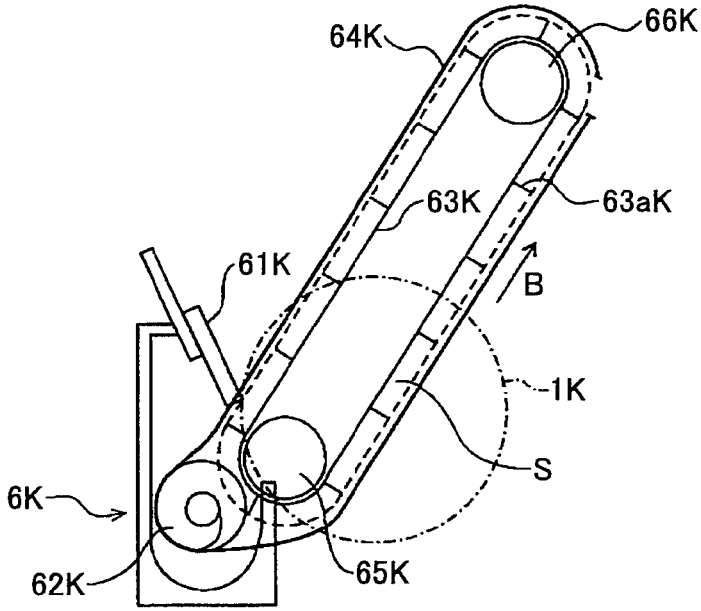
FIG. 4 illustrates a positional relationship between a waste toner collecting belt and other members of the process cartridge for the color K shown in FIG. 3.

FIG. 4 illustrates a positional relationship between a waste toner collecting belt 63K provided in the process cartridge 10K and not shown in FIG. 3 and other members of the process cartridge 10K.

At an end of the process cartridge 10K is provided a waste toner conveyance part 64K that extends from the drum cleaning apparatus 6K to a waste toner receiving part 72K of the toner container 7K (not shown in FIG. 4). A bottom end of the waste toner conveyance part 64K communicates with the drum cleaning apparatus 6K and a top end of the waste toner conveyance part 64K communicates with the waste toner receiving part 72K of the toner container 7K. In the inside of the waste toner conveyance part 64K, the endless waste toner collecting belt 63K is provided, and is extended between and wound on a following roller 65K and a driving roller 66K in a tensioned state. On an outer circumferential surface of the waste toner collecting belt 63K, protrusion parts 63*a*K are formed at predetermined intervals. The protrusion parts 63*a*K of the waste toner collecting belt 63K have a width the same as a width of the waste toner collecting belt 63K, and tops of the protrusion parts 63*a*K have heights such that the top surfaces of the protrusion parts 63*a*K touch without gaps a surface of the waste toner conveyance part 64K facing the waste toner collecting belt 63K.

Toner removed from the photosensitive member 1K by the drum cleaning apparatus 6K is, as waste toner, conveyed to the bottom end of the waste toner conveyance part 64K at an end part of the process cartridge 10K, by a waste toner conveying member 62K. The waste toner thus conveyed to the bottom of the waste toner conveyance part 64K is raked up by the protrusion parts 63*a*K of the waste toner collecting belt 63K. The waste toner that has been thus raked up by the protrusion parts 63*a*K is held, as shown in FIG. 4, in a space S between the protrusion parts 63*a*K and a bottom surface of the waste toner conveyance part 64K and is conveyed upward (in a direction indicated by an arrow B). After the waste toner is thus conveyed to an upper part of the waste toner conveyance part 64K by the waste toner collecting belt 63K, the waste toner falls to a waste toner receiving path (not shown). The waste toner thus having fallen to the waste toner receiving path is then conveyed to the waste toner receiving part 72K by a waste toner collecting screw 73K (see FIG. 3). The toner that has been thus received by the waste toner receiving part 72K is not used again for a developing purpose, and is kept stored in the waste toner receiving part 72K.

The toner container 7K is provided detachably from the apparatus body of the developing apparatus 4K, and, after the new toner in the toner storage part 71K runs out, the toner container 7K is removed from the apparatus body of the developing apparatus 4K, and is replaced with another toner container 7K in which new toner is held. At the same time, the waste toner stored in the waste toner receiving part 72K of the toner container 7K is also collected.

Figure 5:
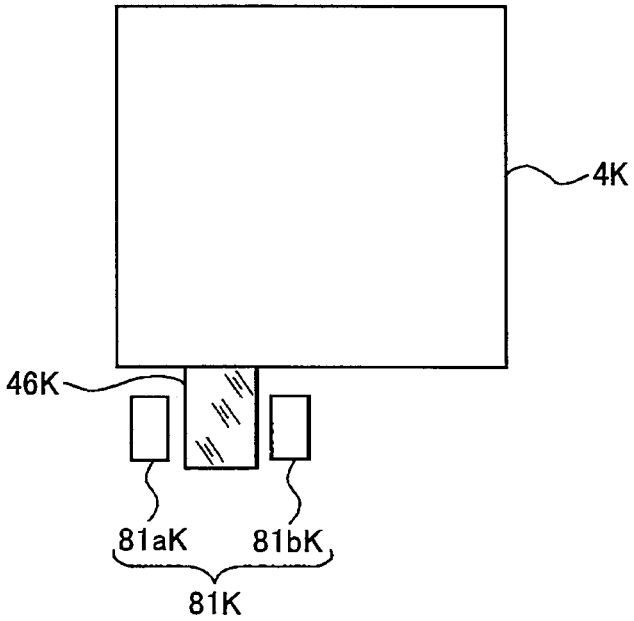
FIG. 5 shows a plan view of a developing apparatus for the color K shown in FIGS. 2 and 3.

Further, the developing apparatus 4K has a detecting window 46K made from transparent material and protruding from a case of the developing apparatus 4K (see FIG. 5).

FIG. 5 shows a plan view of the developing apparatus 4K. As shown in FIG. 5, a light receiving part 81*a*K and a light emitting part 81*b*K of a transmission optical sensor 81K that is a height detecting part are disposed to face one another to sandwich the detecting window 46K. The detecting window 46K includes a hollow part (not shown), and the hollow part communicates with the inside of the developing apparatus 4K. In a case where the height of the toner held in the developing apparatus 4K is higher than the detecting window 46K, the hollow part of the detecting window 46K is filled with the toner, and light emitted by the light emitting part 81*b*K of the transmission optical sensor 81K is blocked by the toner. Thereby, the light receiving part 81*a*K does not detect light, and an output value of the light receiving part 81*a*K is approximately zero. After the toner in the developing apparatus 4K is consumed, the height of the toner in the developing apparatus 4K I lowered, and the height of the toner in the developing apparatus 4K becomes lower than the position of the detecting window 46K. As a result, since there is no toner in the hollow part of the detecting window 46K, the light emitted by the light emitting part 81*b*K is transmitted by the detecting window 46K and thus is received by the light receiving part 81*a*K. As a result, a predetermined output value is obtained from the light receiving part 81*a*K, and thus, it is detected that the height of the toner held in the developing apparatus 4K becomes equal to or less than a predetermined height value. Thus, the control part 90 detects the toner remaining amount in the developing apparatus 4K. That is, according to the present embodiment, the transmission optical sensor 81K that is the height detecting part and the control part 90 act as a remaining amount detecting part that detects the toner remaining amount in the developing apparatus 4K. According to the present embodiment, the transmission optical sensor 81K is used to detect the toner remaining amount in the developing apparatus 4K based on the height of the toner held in the developing apparatus 4K. However, instead, a piezoelectric sensor or such may be provided in the inside of the developing apparatus 4K, and the toner remaining amount may be detected directly by using the piezoelectric sensor or such provided in the inside of the developing apparatus 4K. The control part 90 is, for example, a computer. Further, when the control part 90 has detected that the toner height in the developing apparatus 4K becomes less than the predetermined height value by means of the transmission optical sensor 81K, the control part 90 may start counting dots included in an image to be output by using the process cartridge 10K, and the control part 90 may estimate a toner consumption amount from the number of dots obtained from the counting. Then, after the number of dots (estimated toner consumption amount) has become a predetermined number value, the control part 90 may determine that the toner remaining amount in the developing apparatus 4K becomes less than a predetermined toner amount value.

The control part 90 drives and rotates the conveying member 71*b*K (see FIG. 3) after the toner remaining amount becomes less than the predetermined toner amount value, and the new toner is supplied from the toner storage part 71K to the developing apparatus 4K through the process described above with reference to FIG. 3. Thus, the control part 90 and the conveying member 71*b*K act as a toner supplying part. Further, the flowability of the toner varies depending on temperature and humidity conditions of the developing apparatus 4K. Therefore, in a case where the conveying member 71*b*K is driven for a fixed driving time period at any time, an amount of the new toner supplied to the developing apparatus 4K may vary depending on the environmental conditions of the developing apparatus 4K. Therefore, it is preferable to change the driving time period of the conveying member 71*b*K based on detection results of temperature and humidity sensors (not shown). When the transmission optical sensor 81K has detected that the toner height in the developing apparatus 4K is still less than the predetermined height value (or has detected that the toner remaining amount in the developing apparatus 4K is less than the predetermined toner amount value) even after the toner is thus supplied, the control part 90 displays an indication of "toner end" on a display panel (not shown) of the printer 100, and thus urges the user to replace the toner container 7K.

The above-mentioned drum cleaning apparatus 6K includes a cleaning blade 61K, an extending end of which is in contact with the surface of the photosensitive member 1K and which is made of an elastic body, and the waste toner conveying member 62K for conveying the waste toner removed by the cleaning blade 61K from the surface of the photosensitive member 1K to the waste toner conveyance part 64K (see FIG. 4).

The process cartridge 10K has been described above with reference to FIGS. 3, 4 and 5. Each of the process cartridges 10Y, 10M and 100 for the other colors Y, M and C, respectively, has the same configuration as that of the process cartridge 10K for the color K, and Y, M and C toner images are formed on the surfaces of the photosensitive members 1Y, 1M and 1C, respectively, by the same processes. Therefore, duplicate descriptions are omitted.

As shown in FIG. 2A, a transfer unit 30 that is a transferring part and includes an intermediate transfer belt 15 that is an endless moving member is provided below in a vertical direction of the process cartridges 10Y, 10M, 10C and 10K. The intermediate transfer belt 15 is extended between and wound on a tension roller 23 and a driving and secondary transfer facing roller 21 in a tensioned state, and is rotated in a direction of an arrow C shown in FIG. 2A, as the driving and secondary transfer facing roller 21 is driven by a driving motor (not shown) mounted in an extending direction of the driving and secondary transfer facing roller 21. The transfer unit 30 includes, in addition to the intermediate transfer belt 15, four primary transfer rollers 5Y, 5M, 5C and 5K, and a belt cleaning apparatus 33. The transfer unit 30 is configured as being detachable from the body of the printer 100, and is configured such that consumable parts can be replaced at a time.

In this configuration, in a case where image forming is carried out in a negative positive way (in which an absolute value of an electrical potential at an exposed part is lower than an absolute value of an electrical potential at a non-exposed part, and toner adheres to the exposed part), the surfaces of the respective photosensitive members 1Y, 1M, 1C and 1K are uniformly electrified by the respective electrifying apparatuses 2Y, 2M, 2C and 2K in the negative polarity. Next, from an exposure apparatus 130 as a latent image forming part disposed above in the vertical direction of the photosensitive members 1Y, 1M, 1C and 1K, light beams 3Y, 3M, 3C and 3K according to given image information are applied to the respective photosensitive members 1Y, 1M, 1C and 1K, and thereby, latent images for the respective colors are formed on the respective photosensitive members 1Y, 1M, 1C and 1K. As the exposure apparatus 130, a laser beam scanner using laser diodes or such may be used. Next, as a result of developing biases in negative polarity having absolute values larger than the electrical potentials at the exposed parts being applied to the developing rollers 41Y, 41M, 41C and 41K of the respective developing apparatuses 4Y, 4M, 4C and 4K from the power source 110, the toners carried by the developing rollers 41Y, 41M, 41C and 41K are moved to the latent images on the photosensitive members 1Y, 1M, 1C and 1K, and are made to adhere to the latent images. Thereby, toner images corresponding to the latent images are formed on the photosensitive members 1Y, 1M, 1C and 1K.

The toner images of the respective colors thus developed by the developing apparatuses 4Y, 4M, 4C and 4K, respectively, are primarily transferred to the intermediate transfer belt 15 as an intermediate transfer member, in such a manner that the respective toner images are superposed to form a color image. The toners not having been transferred to the intermediate transfer belt 15 and remaining after the transfer process on the respective photosensitive members 1Y, 1M, 1C and 1K are removed from the surfaces of the photosensitive members 1Y, 1M, 1C and 1K by the cleaning blades 61Y, 61M, 61C and 61K of the respective cleaning apparatuses 6Y, 6M, 6C and 6K.

Further, a paper supply cassette (not shown) is provided below in the vertical direction of the intermediate transfer belt 15 in the printer 100. Transfer paper fed from the paper supply cassette is conveyed by a conveyance belt (not shown) as being guided by a conveyance guide (not shown), and is sent to a temporary stopping position at which a registration roller (not shown) is provided. Then, at a predetermined timing, the transfer paper is supplied by the registration roller to a secondary transfer part between a part of the intermediate transfer belt 15 at which the intermediate transfer belt 15 is wound on the secondary transfer facing roller 21 and a secondary transfer roller 22. Then, as a result of a predetermined secondary bias being applied to the secondary transfer roller 22 by the power source 110, the color image (toner images) formed on the intermediate transfer belt 15 is secondarily transferred to the transfer paper, and the color image is thus formed on the transfer paper. The color image (toner images) formed on the transfer paper is fixed by a fixing unit 26, and after that, the transfer paper is ejected to a paper ejecting tray (not shown). Further, the toners remaining on the intermediate transfer belt 15 after the secondary transfer process are removed by the belt cleaning apparatus 33. The toners thus removed by the belt cleaning apparatus 33 are, as waste toners, conveyed to a waste toner receiving part (not shown and corresponding to the waste toner receiving part 72K of the toner container 7K) of the toner container 7Y from the belt cleaning apparatus 33, through a conveyance part (not shown).

Further, the printer 100 has a contact/apart mechanism 50 as a contact/apart part which causes the intermediate transfer belt 15 to come into contact with and be removed from the photosensitive members 1Y, 1M and 1C.

Figure 6A:
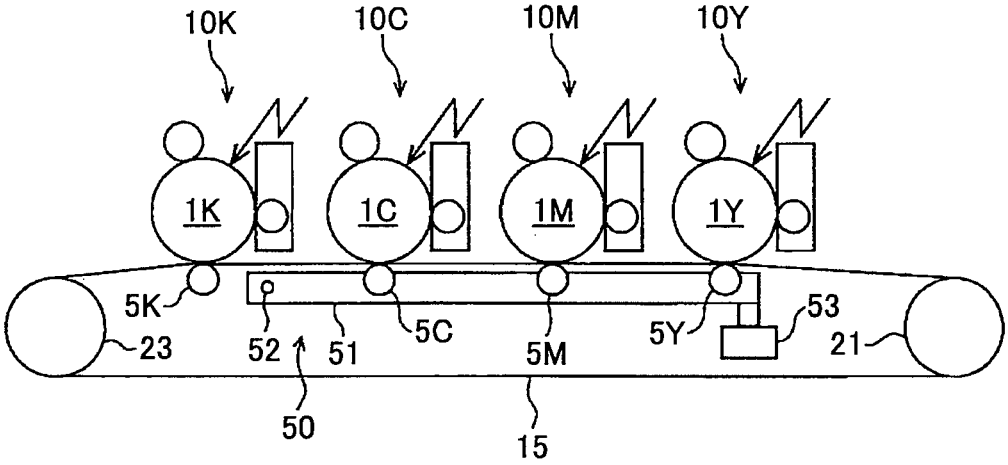
FIGS. 6A and 6B show a general configuration of a contact/apart mechanism in the printer of the embodiment of the present invention.
Figure 6B:
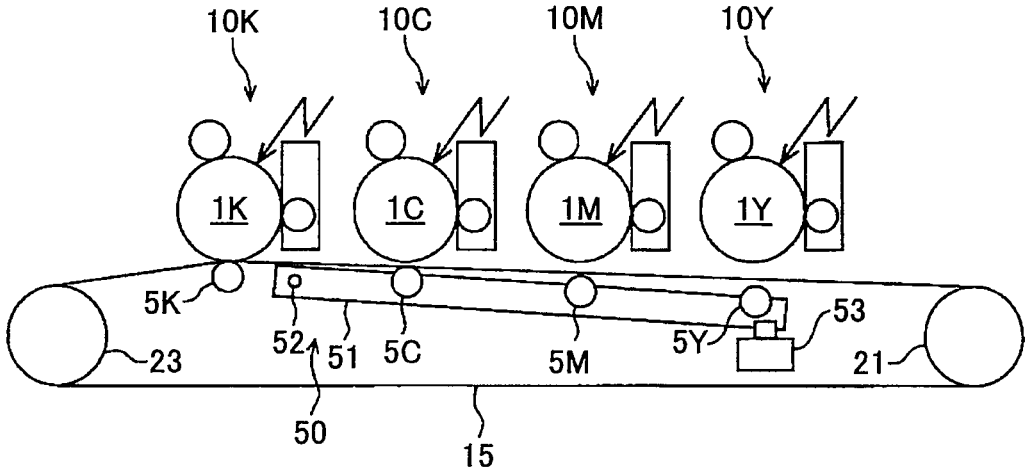

FIGS. 6A and 6B show a general configuration of the contact/apart mechanism 50.

As shown in FIGS. 6A and 6B, the contact/apart mechanism 50 has a pivoting member 51 that supports the primary transfer rollers 5Y, 5M and 5C, one end of the pivoting member 51 being supported in a pivotable manner by a rotation shaft 52. The other end of the pivoting member 51 is supported by a solenoid 53, and, as being driven by the solenoid 53, the pivoting member 51 slightly rotates clockwise in FIGS. 6A, 6B. In a case where a monochrome image is to be formed, as being driven by the solenoid 53, the pivoting member 51 is slightly rotated clockwise. By the rotating, as shown in FIG. 6B, the intermediate transfer belt 15 is removed from the photosensitive members 1Y, 1C and 1M for the colors Y, C and M. Then, only the process cartridge 10K for the color K is driven from among the four process cartridges 10Y, 10M, 10C and 10K, and a monochrome image is formed. Thus, in cases of forming monochrome images, it is possible to avoid uselessly driving the process cartridges for the colors Y, C and M, and it is possible to prevent the process cartridges for the colors Y, C and M from being expended.

Further, as shown in FIG. 2A, in a downstream side in the moving direction of the intermediate transfer belt 51 with respect to the process cartridge 10K of the color K, a reflection optical sensor 150 is provided to detect a toner amount of toner adhering to the surface of the intermediate transfer belt 15.

Figure 7:
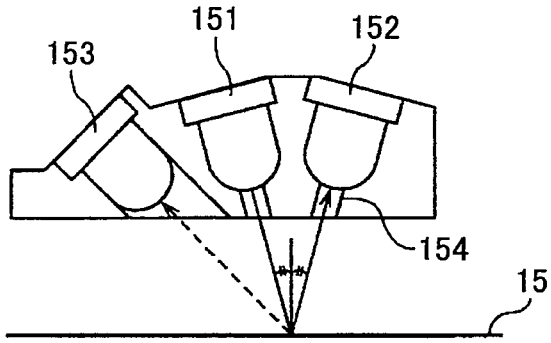
FIG. 7 shows a general configuration of a reflection optical sensor in the printer of the embodiment of the present invention.

FIG. 7 shows a general configuration of the reflection optical sensor 150. The reflection optical sensor 150 includes a light emitting device (LED: light emitting diode) 151, a specular reflection light receiving device 152 made of a phototransistor that receives specular reflection light and a diffuse reflection light receiving device 153 made of a phototransistor that receives diffuse light. The specular reflection light receiving device 152 is disposed symmetrically with the light emitting device 151 with respect to a vertical surface. An aperture 154 is provided in front of the specular reflection light receiving device 152 for avoiding receiving diffuse light as much as possible. The diffuse reflection light receiving device 153 is disposed on the opposite side of the specular reflection light receiving device 152 with respect to the light emitting device 151.

By using the reflection optical sensor 150, it is possible to detect the toner adhesion amount on the intermediate transfer belt 15. Specifically, the surface of the intermediate transfer belt 15 is so smooth as to behave as a mirror surface, and therefore, specular reflection light is dominant in light obtained from being emitted by the light emitting device 151 and then being reflected by the surface of the intermediate transfer belt 15. On the other hand, a part at which toner adheres to the intermediate transfer belt 15 has a coarse surface, and therefore, diffuse reflection light becomes dominant over specular reflection light. Accordingly, by measuring a ratio between specular reflection light and diffuse reflection light reflected by the intermediate transfer belt 15, it is possible to estimate the toner adhesion amount by estimating a ratio between an area in which toner adheres and an area in which no toner adheres (bare or exposed surface area) on the intermediate transfer belt 15. Mainly, the specular reflection light receiving device 152 is used for detecting a toner adhesion amount of K toner and detecting low (small) toner adhesion amounts of color toners (Y, M and C toners). On the other hand, the diffuse reflection light receiving device 153 is used for detecting high (large) toner adhesion amounts of color toners (Y, M and C toners).

Next, toner supply control operation will be described.

Figure 8:
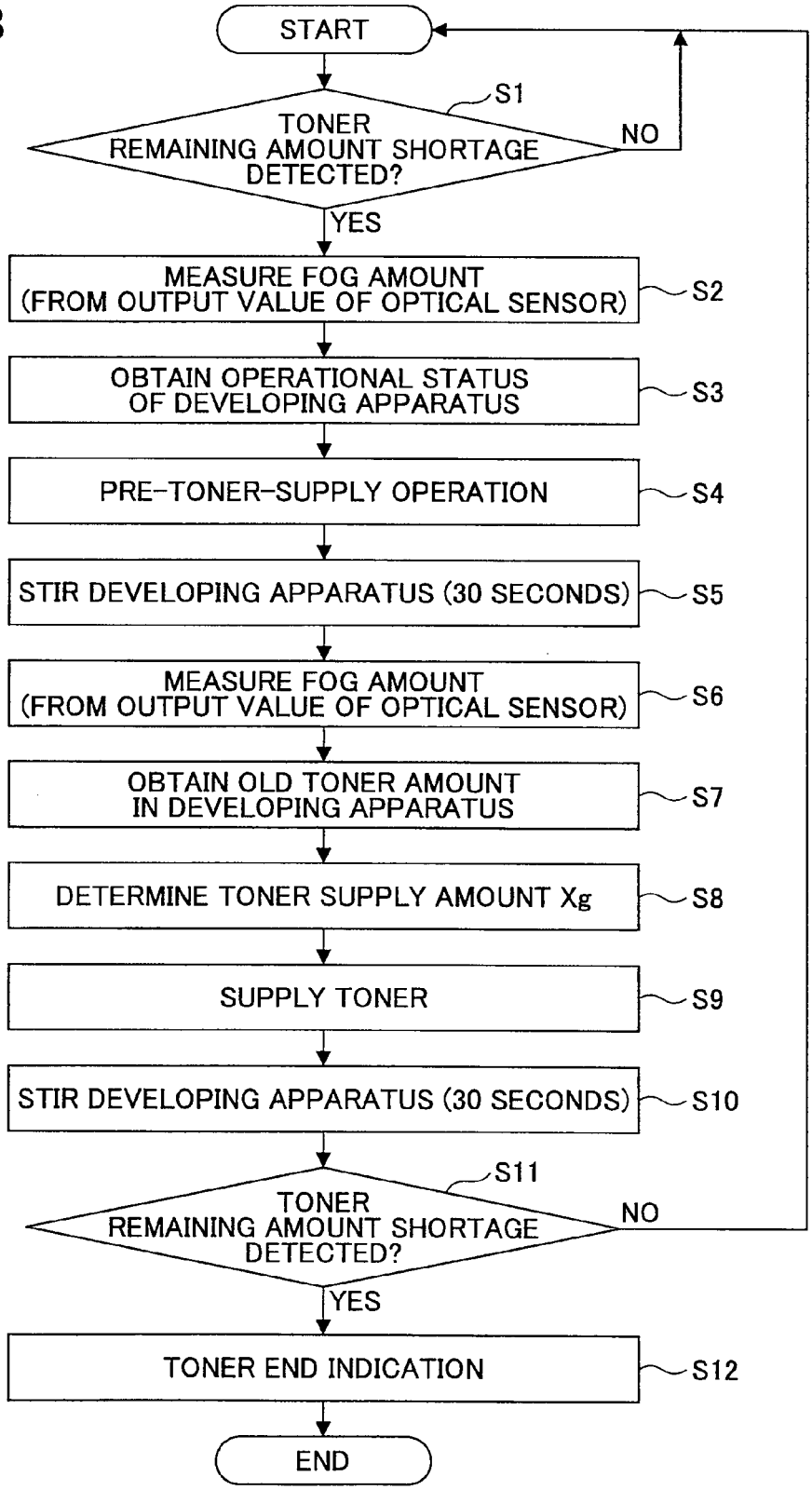
FIG. 8 shows a flowchart of a toner supply control operation according to the embodiment of the present invention.

As mentioned above, for the sake of convenience, description is made only for the developing apparatus 4K for example. However, also to the other developing apparatuses 4Y, 4M and 4C, the same description is applicable, and duplicate description is omitted. As shown in FIG. 8, when the control part 90 has detected based on the output signal of the transmission optical sensor 81K (see FIG. 5) that the toner remaining amount in the developing apparatus 4K is less than the predetermined toner amount value (step S1 YES), the control part 90 carries out a fog detecting process (step S2).

When the fog detecting process is thus carried out, a blank paper image as a fog detecting image is formed on the intermediate transfer belt 15. Specifically, in a case where the toner remaining amount in the developing apparatus 4K for the color K becomes less than the predetermined toner amount value, the electrifying apparatus 2K of the process cartridge 10K including the developing apparatus 4K uniformly electrifies the surface of the photosensitive member 1K, no exposure is carried out by the exposure apparatus 130, and the predetermined developing bias is applied to the developing roller 41K. Thereby, the blank paper image is formed on the photosensitive member 1K. In a case where deterioration of old toner remaining in the developing apparatus 4K is minor, and the old toner is sufficiently electrified, the toner hardly moves to the photosensitive member 1K, and fog hardly occurs. On the other hand, in a case where the toner in the developing apparatus 4K is deteriorated, and the electrification amount in the toner is small, the force operating on the toner such that the toner is prevented from moving from the developing roller 41K because of the electric field between the developing roller 41K and the photosensitive member 1K becomes weaker. Therefore, the deteriorated weak-electrified toner adheres to the photosensitive member 1K. As a result, fog in the blank paper image becomes worse. Then, the blank paper image is transferred to the intermediate transfer belt 15, and the blank paper image is then detected by the reflection optical sensor 150 disposed on the downstream side in the moving direction of the intermediate transfer belt 15 with respect to the process cartridge 10K for the color K as shown in FIG. 2A, and the control part 90 detects the fog based on the detection result of the reflection optical sensor 150. That is, the reflection optical sensor 150 and the control part 90 act as a fog detecting part.

When the blank paper image having a little fog is detected by the reflection optical sensor 150, the output value of the specular reflection light receiving device 152 is approximately maximum and the output value of the diffuse refection light receiving device 153 becomes approximately minimum, since toner hardly adheres to the intermediate transfer belt 15. On the other hand, when the blank paper image having remarkable fog is detected by the reflection optical sensor 150, the output value of the specular refection light receiving device 152 decreases and the output value of the diffuse refection light receiving device 153 increases, since much toner (weak-electrified toner) adheres to the intermediate transfer belt 15. In the present embodiment, fog is detected based on the output value of the specular light receiving device 152. Specifically, an adhesion amount conversion table in which the output value of the specular light receiving device 152 and the toner adhesion amount are associated with one another is stored in a memory 95 of a non-volatile type (see FIG. 2B). Then, based on the output value of the specular light receiving device 152 and the adhesion amount conversion table, a fog amount (adhesion amount) is obtained. Further, generally speaking, the adhesion amount conversion table for the color K and the adhesion amount conversion table for the color toners (Y, M and C colors) are prepared separately.

Next, based on the thus-obtained fog amount, an operational status (running distance) of the developing apparatus 4K since the supplying of toner the last time is obtained (step S3). As shown in FIG. 1, it is seen that, the fog amount for when the new toner is 0%, i.e., all the toner in the developing apparatus 4K is old toner, varies for the respective running distances (5 km and 10 km in the example of FIG. 1). Therefore, in the memory 95 of the printer 100, a developing apparatus operational status obtaining table in which the running distance and the fog amount for when the new toner is 0% are associated with one another is stored, and the operational status of the developing apparatus 4K is obtained from the developing apparatus operational status obtaining table and the detected fog amount.

After the operational status of the developing apparatus 4K is thus obtained, a process of obtaining the old toner amount remaining in the developing apparatus 4K is carried out. Specifically, first, a pre-toner-supply operation of supplying 10 g of new toner to the developing apparatus 4K is carried out (step S4). In the present embodiment, as shown in FIG. 3, it is possible to control, with relatively high accuracy, a new toner supply amount to the developing apparatus 4K by controlling the driving time period of the conveying member 71*b*K in the toner storage part 71K. Further, as described above, in the present embodiment, such control that the driving time is changed according to the temperature and humidity conditions and/or toner flowability variation due to toner deterioration can be carried out. Therefore, it is possible to supply 10 g of new toner to the developing apparatus 4K with very high accuracy. In the present embodiment, by driving the conveying member 71*b*K for 30 seconds, it is possible to supply 10 g of new toner to the developing apparatus 4K. The new toner supply amount in the pre-toner-supply operation is determined such that a ratio of new toner in the developing apparatus 4K becomes equal to or less than 30%. This is because, as shown in FIG. 1, in a case where the ratio of new toner in the developing apparatus 4K is equal to or less than 30% (around the left end of FIG. 1), the relationships between the ratio of new toner in the developing apparatus 4K and the fog amount vary in monotonously decreasing (i.e., increasing in fog amount) manners approximately linearly. Therefore, in this condition, it is possible to obtain a ratio of the new toner in the developing apparatus 4K after the pre-toner-supply operation by using a linear approximation equation (i.e., $y=ax+b$), and thus, it is possible to easily and precisely obtain a ratio of the new toner in the developing apparatus 4K after the pre-toner-supply operation. On the other hand, in a case where a ratio of new toner in the developing apparatus 4K is 50±20%, the fog amounts have peaks (local minimum values in the example of FIG. 1) as shown in FIG. 1, and thus, it is not possible to precisely obtain a ratio of the new toner.

Next, the toner in the developing apparatus 4K is stirred for 30 seconds (step S5). Thereby, the deteriorated old toner and the new toner rub together in the developing apparatus 4K, and thereby, the old toner may become weakly electrified, or may become electrified to positive polarity reverse to the normal electrification polarity (negative polarity). After the toner in the developing apparatus 4K is thus stirred for 30 seconds, the fog detecting process the same as the above (step S2) is carried out, and the fog amount is detected (step S6). Next, the old toner amount remaining in the developing apparatus 4K is obtained (step S7) from the fog amount detected in step S6, the operational status of the developing apparatus 4*k* since the toner was supplied the last time obtained in step S3 and the new toner amount (10 g) supplied in the pre-toner supply operation (step S4). Specifically, in the memory 95 of the printer 100 is stored a new toner ratio obtaining table, in which table the operational status of the developing apparatus 4K and the linear approximation equation ($y=ax+b$), in which equation the ratio of new toner and the fog amount are associated with each other, are associated with each other. Then, from the operational status of the developing apparatus 4K obtained in step S3 and the new toner ratio obtaining table, the corresponding linear approximation equation is obtained.

Then, based on the determined linear approximation equation and the detected fog amount, the ratio of new toner in the developing apparatus 4K is obtained. Next, because the new toner amount supplied at the time of the pre-toner-supply operation is known as 10 g, the old toner amount remaining in the developing apparatus 4K is obtained from the obtained ratio of new toner in the developing apparatus 4K and the new toner amount (10 g) supplied in the pre-toner-supply operation.

After the old toner amount remaining in the developing apparatus 4K is thus obtained in step S7, a new toner amount Xg to be supplied to the developing apparatus 4K is determined (step S8). Specifically, as shown in FIG. 1, the new toner amount Xg is determined such that a ratio of new toner in the developing apparatus 4K after the new toner amount Xg is supplied becomes such that fog is equal to or less than an allowable level. For example, a ratio of new toner such that fog becomes the allowable level for a condition of the longest running distance expectable in an ordinary operation condition may be prescribed, and the new toner amount Xg may be determined such that the ratio of new toner becomes the prescribed value. Instead, a table in which the operational status of the developing apparatus 4K and the ratio of new toner such that fog becomes in the allowable level are associated with each other may be stored in the memory 95, and the ratio of new toner such that fog becomes in the allowable level may be determined from the operational status of the developing apparatus and the stored table. Then, the new toner amount Xg is determined based on the determined ratio of new toner and the old toner amount obtained in step S7.

For example, when the new toner amount in the developing apparatus 4K after the pre-toner-supply operation has been obtained as 25% in step S7, the old toner amount remaining in the developing apparatus 4K is obtained as 30 g in step S7 since the new toner amount supplied in the pre-toner-supply operation is 10 g as mentioned above, and thus, in the developing apparatus 4K after the pre-toner-supply operation the new toner is 10 g accordingly. That is, since 10 g corresponds to 25%, the remaining 75% (old toner) corresponds to 30 g accordingly. Then, in a case where the ratio of new toner in the developing apparatus 4K after the new toner amount Xg is supplied is determined as 70% in step S8, the toner amount Xg=70 [g] is thus to be supplied. This is because the old toner in the developing apparatus 4K is 30 g as mentioned above, and therefore, 70% of new toner in the developing apparatus 4K can be achieved as a result of 70 g of new toner being supplied (that is, 70 [g]/(30 [g]+70 [g])=70/100=0.70). Then, since 10 g of new toner has been already supplied in the pre-toner-supply operation (step S4), 60 g of new toner is to be further supplied, which is a difference between the above-mentioned target value 70 g and the above-mentioned already-supplied value 10 g. Thus, the new toner supply amount Xg is 60 g.

After the new toner amount Xg is thus determined in step S8, the control part 90 controls driving of the conveying member 71*b*K, and supplies the determined new toner amount Xg of new toner to the developing apparatus 4K (step S9).

After the new toner is thus supplied to the developing apparatus 4K in step S9, the toner in the developing apparatus 4K is stirred for 30 seconds (step S10), and the toner remaining amount in the developing apparatus 4K is detected by using the transmission optical sensor 81K (step S11). When the toner remaining amount in the developing apparatus 4K is still less than a threshold (step S11 YES), which means that there is no new toner left in the toner storage part 71K, therefore the control part 90 displays the indication of "toner end" on the display panel of the printer 100, and thus, urges the user to replace the toner container 7K (step S12).

Thus, according to the present embodiment, it is possible to precisely determine the old toner amount remaining in the developing apparatus 4K, and therefore, it is possible to supply the minimum necessary amount of new toner to be able to control fog occurring after the new toner is supplied to the allowable level. Thus, it is not necessary to supply a large amount of new toner to prevent fog occurring after new toner is supplied, and it is possible to avoid an increase in torque of the agitator 43K and/or the toner supply roller 42K. Further, it is possible to prevent toner packing from occurring.

Further, according to the present embodiment, the process starting from step S2 of FIG. 8 of the toner supply control operation for supplying new toner in the developing apparatus 4K is carried out after it is detected in step S1 by the remaining amount detecting part including the transmission optical sensor 81K and the control part 90 that the toner remaining amount in the developing apparatus 4K becomes less than the predetermined toner amount value. Thus, the process starting from step S2 of FIG. 8 of the toner supply control operation for supplying new toner in the developing apparatus 4K is carried out when the old toner amount in the developing apparatus 4K has been sufficiently reduced. Therefore, it is possible to reduce the necessary new toner supply amount determined in step S8 of FIG. 8 to cause the ratio of the new toner to be such that fog can be reduced to be equal to or less than the allowable level. Thus, it is possible to prevent the toner amount in the developing apparatus 4K after new toner is supplied from becoming much. Further, since supplying new toner is not carried out until the toner amount in the developing apparatus 4K is reduced to be less than the predetermined toner amount, the process starting from step S2 of FIG. 8 of the toner supply control operation for supplying new toner in the developing apparatus 4K is carried out after the deterioration of the old toner remaining in the developing apparatus 4K progresses to a certain degree. As a result, it is possible to precisely determine the old toner amount remaining in the developing apparatus 4K in step S7.

Description has been made for the developing apparatus 4K for the color K as an example. As mentioned above, the same toner supply control of FIG. 8 is carried out also for each of the other developing apparatuses 4Y, 4M and 4C for the other colors Y, M and C, and duplicate description therefor will be omitted.

In the above-mentioned configuration, the process starting from step S2 of FIG. 8 of the toner supply control operation for supplying new toner in the developing apparatus 4K is carried out after it is determined in step S1 that the toner remaining amount in the developing apparatus 4K becomes less than the predetermined toner amount. However, instead, for example, the process starting from step S2 of FIG. 8 of the toner supply control operation for supplying new toner in the developing apparatus 4K may be carried out after a predetermined time period has elapsed.

Further, a gloss level on the surface of the intermediate transfer belt 15 may vary as a result of the surface of the intermediate transfer belt 15 being deteriorated because of having been used for a long time period. When the gloss level on the surface of the intermediate transfer belt 15 varies, the output value of the reflection optical sensor 150 varies, and precise fog detection may not be able to be carried out. Therefore, correction of the detection result of the fog detection may be carried out by using a detection result of the reflection optical sensor 150 obtained when no toner has adhered to the surface of the intermediate transfer belt 15. Specifically, for a case of the color K, after a blank paper image is developed on the surface of the photosensitive member 1K, the developing roller 41K is removed from the photosensitive member 1K. Next, the blank paper image formed on the intermediate transfer belt 15 is detected by means of the reflection optical sensor 150. Next, the reflection optical sensor 150 is used to detect in an area on the intermediate transfer belt 15 where the intermediate transfer belt 15 comes into contact with an area on the photosensitive member 1K where the developing roller 41K has been thus removed from the photosensitive member 1K. The area on the intermediate transfer belt 15 is the area where the intermediate transfer belt 15 comes into contact with the area on the photosensitive member 1K where the developing roller 41K does not come into contact with the photosensitive member 1K. Therefore, no toner has adhered to the area on the intermediate transfer belt 15. Accordingly, by detecting in the area on the intermediate transfer belt 15 by means of the reflection optical sensor 150, it is possible to precisely detect a variation in the gloss level on the intermediate transfer belt 15. Then, by calculating a difference value (Vsp_dif'−Vsp_dif) between a detection value Vsp_dif obtained when the blank paper image has been detected and a detection value Vsp_dif' obtained when the above-mentioned area on the intermediate transfer belt 15 coming into contact with the area on the photosensitive member 1K where the developing roller 41K has been removed from the photosensitive member 1K has been detected, it is possible to precisely detect, by using the absolute value of the difference value (Vsp_dif'−Vsp_dif), the fog amount from which the variation in the gloss level on the intermediate transfer belt 15 has been removed. Thus, it is possible to carry out precise fog detection through aging.

In a case of each of the Y, M and C colors, in fog detecting operation, after a blank paper image is formed on the intermediate transfer belt 15, the intermediate transfer belt 15 is removed from the photosensitive members 1Y, 1M and 1C by means of the contact/apart mechanism 50 described above with reference to FIGS. 6A and 6B. Then, after the blank paper image thus formed on the intermediate transfer belt 15 is detected, an area on the intermediate transfer belt 15 is detected, which area on the intermediate transfer belt 15 is the area having moved and come without coming into contact with the photosensitive member 1Y, 1M and 1C after passing the belt cleaning apparatus 33. The area on the intermediate transfer belt 15 thus has not come into contact with the photosensitive member 1Y, 1M and 1C, and therefore, no toner has adhered to the area on the intermediate transfer belt 15. Accordingly, by detecting in the area on the intermediate transfer belt 15 by means of the reflection optical sensor 150, it is possible to precisely detect a variation in the gloss level on the intermediate transfer belt 15. Then, by calculating a difference value (Vsp_dif'−Vsp_dif) between a detection value Vsp_dif obtained when the blank paper image has been detected and a detection value Vsp_dif' obtained when the above-mentioned area on the intermediate transfer belt 15 where the intermediate transfer belt 15 has been removed from the photosensitive members 1Y, 1M and 1C has been detected, it is possible to precisely detect, by using the absolute value of the difference value (Vsp_dif'−Vsp_dif), the fog amount from which the variation in the gloss level on the intermediate transfer belt 15 has been removed. Thus, it is possible to carry out precise fog detection through aging.

Further, a second contact/apart mechanism (not shown) may be provided such that the intermediate transfer belt 15 can be caused to come into contact with and be removed from the photosensitive member 1K for the color K, and a variation in the gloss level on the intermediate transfer belt 15 may be detected in the same method as that for each of the colors Y, M and C described above. The second contact/apart mechanism may include, for example, a supporting member that supports the primary transfer roller 5K for the color K and moves in directions such that the supporting member comes into contact with and is removed from the photosensitive member 1K for the color K; and a moving part such as a solenoid which moves the supporting member in directions such that the supporting member comes into contact with and is removed from the photosensitive member 1K for the color K.

Further, a second reflection optical sensor (not shown) may be provided at a position facing an image not-forming area of the intermediate transfer belt 15, and the fog detection result of the reflection optical sensor 150 may be corrected by using the output value of the second reflection optical sensor. Also by calculating a difference value (Vsp_dif'−Vsp_dif) between a value Vsp_dif' obtained when the second reflection optical sensor has detected in the image not-forming area at an edge part of the intermediate transfer belt 15 and a value Vsp_dif obtained when the reflection optical sensor 150 has detected in the blank paper image, it is possible to precisely detect, by using the absolute value of the difference value (Vsp_dif'−Vsp_dif), the fog amount from which the variation in the gloss level on the intermediate transfer belt 15 has been removed.

In the above-mentioned configuration, before the pre-toner-supply operation is carried out, a blank paper image is formed, fog is detected based on the fog detection result, and the operational status of the developing apparatus is determined. However, it is also possible to determine the operational status of the developing apparatus from the driving time period of the developing roller or such, instead.

Further, in the above-mentioned configuration, the new toner amount supplied to the developing apparatus in the pre-toner-supply operation is 10 g. However, the new toner amount supplied in the pre-toner-supply operation may be changed based on the operational status of the developing apparatus. Specifically, in a case where the operating time period (running distance) of the developing apparatus is short and thus deterioration of the old toner remaining in the developing apparatus is minor, the new toner amount supplied in the pre-toner-supply operation may be made larger. In contrast thereto, in a case where the operating time period (running distance) of the developing apparatus is long and thus deterioration of the old toner remaining in the developing apparatus has progressed, the new toner amount supplied in the pre-toner-supply operation may be made smaller. This is because in the case where the deterioration of the old toner is minor, fog hardly occurs, and therefore, the toner adhesion amount obtained when a blank paper image has been formed is almost zero. In such a case where fog hardly occurs, the output value of the reflection optical sensor obtained when a blank paper image has been detected falls within a range of possible error, and thus, it may not be possible to carry out precise fog detection. As shown in FIG. 1, fog becomes worse (i.e., fog increases) as the ratio of new toner increases in a range where the ratio of new toner is up to around 50%. Therefore, if the new toner amount supplied in the pre-toner-supply operation is small in a case where deterioration of the old toner is minor, the ratio of new toner in the developing apparatus is small, fog hardly occurs, and thus, precise fog detection may not be able to be carried out. Therefore, in the case where the operating time period (running distance) is short and deterioration of the old toner remaining in the developing apparatus is minor, the new toner amount supplied in the pre-toner-supply operation is made larger, and thus, the ratio of new toner in the developing apparatus is made larger. Thereby, fog occurs to a certain degree when a blank paper image has been formed, and toner adheres to the intermediate transfer belt to a certain degree. As a result, the output of the reflection optical sensor can be obtained to a certain degree, and thus, it is possible to detect fog precisely.

On the other hand, in the case where the operating time period (running distance) is long, and therefore, deterioration of the old toner remaining in the developing apparatus has progressed, fog occurs to a certain degree even when the ratio of new toner in the developing apparatus is small. Therefore, the output of the reflection optical sensor can be obtained to a certain degree, and thus, it is possible to detect fog precisely. Accordingly, in the case where the operating time period (running distance) of the developing apparatus is long, the new toner amount supplied in the pre-toner-supply operation is made smaller. For example, in a case where the operating time period of the developing apparatus is longer than an upper limit value, the new toner amount supplied in the pre-toner-supply operation may be made to be 10 g; in a case where the operating time period of the developing apparatus is shorter than a lower limit value, the new toner amount supplied in the pre-toner-supply operation may be made to be 20 g; and in a case where the operating time period of the developing apparatus is equal to or shorter than the upper limit value and equal to or longer than the lower limit value, the new toner amount supplied in the pre-toner-supply operation may be made to be 15 g.

Further, in a case where a certain amount of new toner has been supplied in the pre-toner-supply operation, the fog level obtained after the pre-toner-supply operation is the allowable level and the toner remaining amount in the developing apparatus obtained by using the transmission optical sensor is equal to or more than a threshold, the process including and after step S7 of the toner supply control operation of FIG. 8 may not be carried out and the toner supply control operation may be terminated. Thereby, it is possible to shorten the time period required for the toner supply control operation of FIG. 8, and it is possible to shorten downtime of the developing apparatus. On the other hand, in a case where the fog level obtained after the pre-toner-supply operation is equal to or more (worse) than the allowable level, and/or the toner remaining amount in the developing apparatus obtained by using the transmission optical sensor is equal to or less than the threshold, the process including and after step S7 of the toner supply control operation of FIG. 8 is carried out, and a certain amount of new toner is supplied to the developing apparatus.

Further, in a case where the ratio of new toner after the pre-toner-supply operation is small, a large amount of new toner is to be added for the purpose of causing fog to be equal to or less (better) than the allowable level. In particular, in a case where the operating time period (running distance) of the developing apparatus is long, the ratio of new toner required for causing fog to be less (better) than the allowable level becomes larger, and thus, more amount of new toner is to be supplied. As a result, there may be a case where if new toner is thus added, the toner amount in the developing apparatus will exceed the capacity of the developing apparatus. For example, in a case where the ratio of new toner after the pre-toner-supply operation is 20% and the new toner amount supplied in the pre-toner-supply operation (step S4 of FIG. 8) is 10 g, the old toner amount in the developing apparatus is obtained as 40 g (step S7). In this case, in a case where the ratio of new toner required for causing fog to be equal to or less (better) than the allowable level is 80% and thus, the ratio of new toner after new toner is supplied is made to be 80%, 160 g of new toner in the developing apparatus is required (i.e., 160 [g]/(40 [g]+160 [g])=0.8). Since 10 g of new toner has been already supplied in the pre-toner-supply operation as mentioned above, new toner to be further supplied (steps S8, S9) is 150 g (i.e., 160 [g]−10 [g]=150 [g]). At this time, assuming that the capacity of the developing apparatus is 100 g, only 50 g can be added (i.e., 100 [g]−(40 [g]+10 [g])=50 [g]). If 50 g of new toner is added (step S9), the resulting total amount of new toner becomes 60 g (=10 [g]+50 [g]) that is much smaller than the above-mentioned required amount of 160 g, and thus, fog becomes seriously worse. Therefore, in a case where the resulting toner amount in the developing apparatus would exceed the capacity of the developing apparatus if the new toner supply amount Xg determined in step S8 of FIG. 8 is supplied, a toner ejecting process described below may be carried out.

When the toner ejecting process is carried out, in an example of the color K, the electrifying apparatus 2K uniformly electrifies the surface of the photosensitive member 1K, and the exposure apparatus 130 exposes the entire surface of the photosensitive member 1K. Thereby, the old toner remaining in the developing apparatus 4K adheres to the entire area of an image forming area of the photosensitive member 1K, and thus, it is possible to effectively eject the toner remaining in the developing apparatus 4K to the photosensitive member 1K. The old toner thus having been ejected to the surface of the photosensitive member 1K is transferred to the intermediate transfer belt 15, and is removed by the belt cleaning apparatus 33 from the intermediate transfer belt 15. Then, the toner is conveyed to the waste toner receiving part (corresponding to the waste toner receiving part 72K shown in FIG. 3 in the example of color K) of the toner container 7Y of the color Y as waste toner by the conveyance part from the belt cleaning apparatus 33. It is noted that, at this time, the secondary transfer roller 21 is caused to be apart from the intermediate transfer belt 15.

Further, such a control method may be used instead that the voltage applied to the electrifying apparatus 2K is turned off, the surface of the photosensitive member 1K is not electrified, and the old toner remaining in the developing apparatus 4K is ejected. In this control method, the electrification electric potential on the surface of the photosensitive member 1K is zero and the predetermined developing bias of negative polarity is applied to the developing roller 41K. Therefore, between the photosensitive member 1K and the developing roller 41K, toner of negative polarity on the developing roller 41K electrostatically moves to the photosensitive member 1K. Thus, also in this control method, it is possible that the old toner remaining in the developing apparatus 4K adheres to the entire surface of the image forming area of the photosensitive member 1K. Further, in the case where the control method is used, it is not necessary to expose the surface of the photosensitive member 1K for a long time by the exposure apparatus 130, and it is advantageous that deterioration of the photosensitive member 1K because of light-induced fatigue can be avoided.

Further, such a control method may be used instead that at a time of carrying out the toner ejecting process, the power source 110 is controlled so that such a voltage is applied to the toner supply roller 42K that an absolute value of the voltage applied to the toner supply roller 42K becomes larger, and an electric potential difference between the developing roller 41K and the toner supply roller 42K becomes larger. Thereby, the old toner remaining in the developing apparatus 4K easily moves to the developing roller 41K from the toner supply roller 42K electrostatically. Further, the lamellation blade 45K may be made to be apart from the developing roller 41K. Thereby, the toner layer on the developing roller 41K becomes thicker, and thus, it is possible to move the toner from the developing apparatus 4K to the photosensitive member 1K within a shorter time period.

Thus, a predetermined amount of new toner is supplied under the condition where the toner ejecting process has been carried out and almost all of the toner in the developing apparatus has been removed therefrom. Thereby, it is possible to prevent fog occurring after the new toner is supplied, without causing the toner amount in the developing apparatus to exceed the capacity of the developing apparatus.

Figure 9:
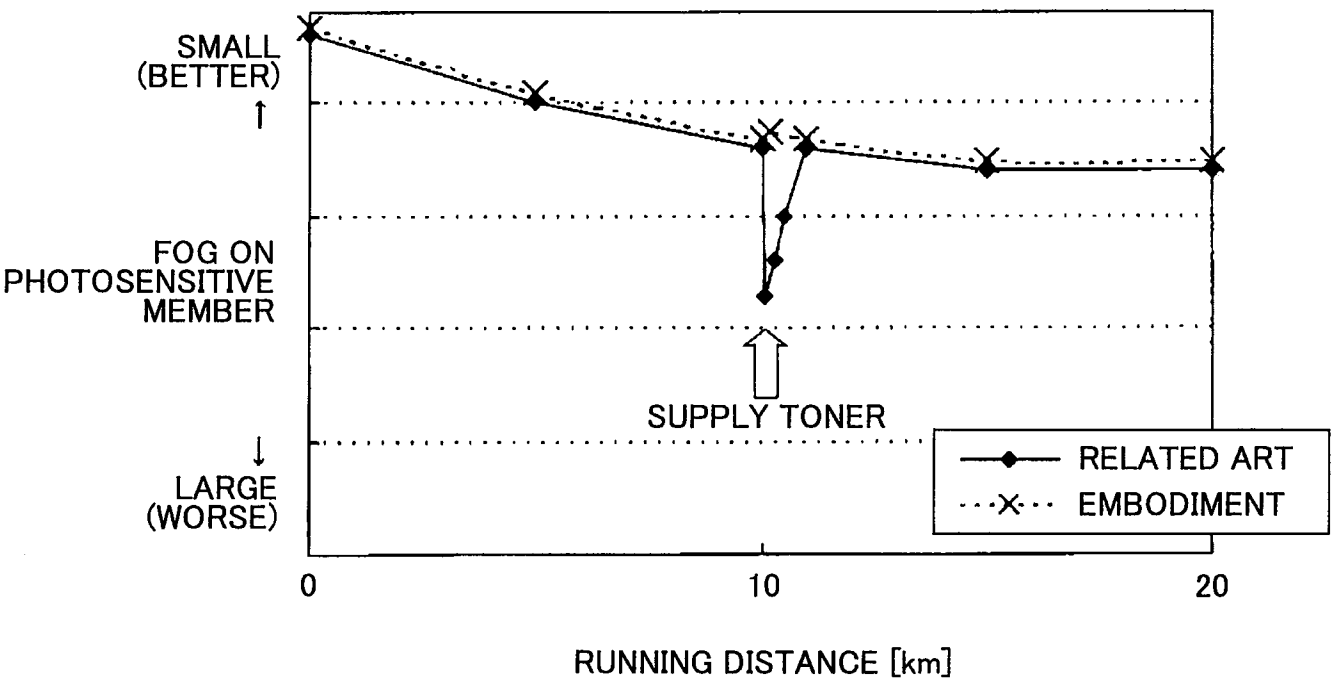
FIG. 9 shows fog variation according to aging of an image forming apparatus in which the toner supply control operation according to the embodiment of the present invention is carried out and fog variation according to aging of an image forming apparatus in the related art.

FIG. 9 shows a variation in fog through aging of an image forming apparatus in which a toner supply control operation according to the present embodiment as shown in FIG. 8 is carried out and a variation in fog through aging of an image forming apparatus in the related art. In FIG. 9, a broken line corresponds to the present embodiment and a solid line corresponds to the related art.

As shown in FIG. 9, in a case of the related art (solid line), fog becomes remarkably worse after toner is supplied (indicated as SUPPLY TONER in FIG. 9). In contrast thereto, according to the present embodiment (broken line) in which the toner supply control operation shown in FIG. 8 is carried out, fog does not become remarkably worse even after toner is supplied.

Next, toner which may be preferably used in the present embodiment will be described.

Materials of the toner are as follows:

Polyester resin A (softening point: 131° C., AV value (acid value): 25) . . . 68 parts Polyester resin B (softening point: 116° C., AV value (acid value): 1.9) . . . 32 parts Master batch of cyan (containing 50 parts of Pigment Blue 15:3) . . . 8 parts Carnauba wax . . . 8 parts The above-mentioned toner materials are sufficiently mixed by a Henschel mixer; after that, by using a two-axis kneading and extruding machine (PCM-30 manufactured by IKEGAI CORPORATION) after an ejecting part thereof is removed, are melted and kneaded, then, the obtained mixture is rolled by using a cooling press roller into 2 mm thickness, is cooled by a cooling belt, and after that, is crushed coarsely by a feather mill. After that, a mechanical grinder (KTM manufactured by KAWASAKI HEAVY INDUSTRY LTD.) is used to crush the materials into an average grain size of 10 through 12 μm. Further, a jet grinder (IDS manufactured by NIPPON PNEUMATIC MFG. CO., LTD.) is used to crush the materials, and classify and remove coarse grains from the materials; and after that, a rotor classifier (Teeplex classifier, type 100ATP, manufactured by HOSOKAWA MICRON CORPORATION) is used to classify the classified fine grains, and thus, a toner parent body A having a volume mean grain size (volume mean diameter) of 7.9 μm and having an average circularity of 0.910 is obtained. 1 part of silica (RX200) is then added to 100 parts of the toner parent body A, a Henschel mixer is used to carry out mixing the materials at a circumferential velocity of 40 m/s, for 5 minutes, and thus, the toner which may be preferably used in the present embodiment is produced.

Figure 10:
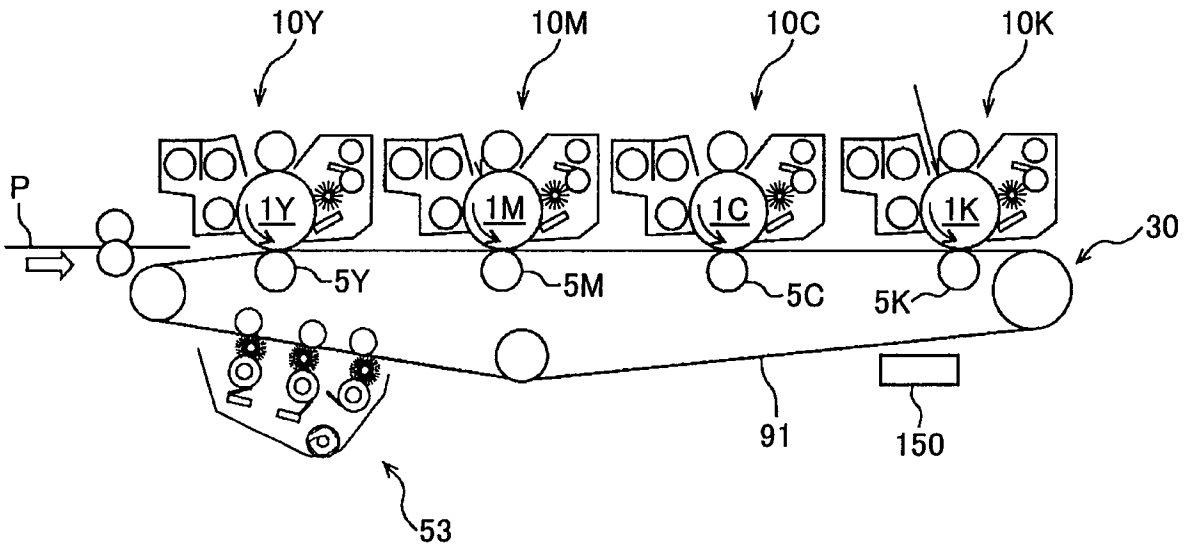
FIG. 10 shows a general partial configuration of a direct-transfer-type image forming apparatus.

Further, in the above description, the example in which the present invention is applied to the image forming apparatus according to the intermediate transfer system (see FIG. 2A) has been described. However, the embodiment is not so limited, and as shown in FIG. 10, the present invention may also be applied to an image forming apparatus according to a direct transfer system. In the image forming apparatus according to the direct transfer system of FIG. 10, a transfer unit 30 that is a transferring part and includes a paper conveyance belt 91 as an endless moving member. The paper conveyance belt 91 is in contact with photosensitive members 1Y, 1M, 1C and 1K, respectively, and provides primary transfer nips for the colors Y, M, C and K, respectively. Then, during a process in which the paper conveyance belt 91 conveys transfer paper P from the left side to the right side of FIG. 10 along with its own endless moving operation as the paper conveyance belt 91 holds the transfer paper P on a surface of the paper conveyance belt 91, the paper conveyance belt 91 feeds the transfer paper P to the primary transfer nips for the colors Y, M, C and K, in sequence. Thus, Y, M, C and K toner images are primarily transferred to the transfer paper P as the Y, M, C and K toner images are superposed. On the downstream side in the belt moving direction of the primary transfer nip of the color K, a reflection optical sensor 150 is disposed. Also in the image forming apparatus of the direct transfer system of FIG. 10, the same as the above described embodiment of FIG. 2A of the intermediate transfer system, in a case where the toner remaining amount in the developing apparatus becomes less than a predetermined toner amount value, the pre-toner-supply operation is carried out and a predetermined amount of new toner is supplied, then a blank paper image is formed on the paper conveyance belt 91; and the reflection optical sensor 150 is used to detect toner in the blank paper image. Based on the thus-detected fog in the blank paper image, the operational status of the developing apparatus and the relationship between the fog amount and the ratio of new toner such as that shown in FIG. 1, the old toner amount remaining in the developing apparatus is obtained. Then, based on the obtained old toner amount remaining in the developing apparatus and the relationship between the fog amount and the ratio of new toner such as that shown in FIG. 1, the new toner amount to be further supplied to the developing apparatus is determined, and the determined amount of new toner is supplied to the developing apparatus.

Thus, the image forming apparatus according to the present embodiment includes the photosensitive members 1Y, 1M, 1C and 1K that are latent image carrying members for carrying latent images; the electrifying apparatuses 2Y, 2M, 2C and 2K that are electrifying parts for electrifying the surfaces of the photosensitive members 1Y, 1M, 1C and 1K; the exposure apparatus 130 that is a latent image writing part for writing the latent images onto the photosensitive members 1Y, 1M, 1C and 1K; the developing apparatuses 4Y, 4M, 4C and 4K that are developing parts for obtaining toner images by developing the latent images on the photosensitive members 1Y, 1M, 1C and 1K by respective toners; and the intermediate transfer belt 15 that is an endless moving member for moving a surface thereof in an endless manner or the transfer unit 30 as a transferring part for transferring the toner images on the photosensitive members 1Y, 1M, 1C and 1K to transfer paper as a recording member held on the surface of the paper conveyance belt 91. Further, the image forming apparatus further includes the toner containers 7Y, 7M, 7C and 7K that hold new toners to be supplied to the developing apparatuses 4Y, 4M, 4C and 4K; and the toner supplying parts (including the control part 90 and the conveying parts (71*b*K in the example of the developing apparatus 4K)) for supplying the new toners from the toner storage parts (71K in the example of the developing apparatus 4K) to the developing apparatuses 4Y, 4M, 4C and 4K. Further, the control part 90 acting as a toner supply amount determining part carries out the pre-toner-supply operation of supplying a predetermined amount of toner to the developing apparatus before further supplying toner to the developing apparatus. After the pre-toner-supply operation, the control part 90 forms a blank paper image as a fog detecting image, and detects toner in the blank paper image by using a fog detecting part (including the reflection optical sensor 150 and the control part 90). Then, the control part 90 determines a toner supply amount to be further supplied to the developing apparatus 4K in the example of the color K based on the detection result of the fog detecting part and the operational status of the developing apparatus 4K from when toner was supplied to the developing apparatus 4K the last time. Then, the toner supplying part supplies the determined toner supply amount of new toner to the developing apparatus 4K. By this configuration, it is possible to supply the minimum necessary amount of toner required for causing fog to be at the allowable level, it is possible to prevent the toner amount in the developing apparatus 4K from becoming too much, and it is possible to prevent fog occurring after new toner is supplied.

Further, in the present embodiment, in the memory 95 of non-volatile type is stored the new toner ratio obtaining table in which the operational status of the developing apparatus and the relational expression (y=ax+b) (i.e., the linear approximation equation) as characteristic information between the ratio of new toner and the fog amount are associated with one another. The control part 90 as the toner supply amount determining part determines the relational expression corresponding to the operational status of the developing apparatus, and obtains the old toner amount remaining in the developing apparatus after the pre-toner-supply operation, based on the determined relational expression, the detection result from the blank paper image and the new toner amount supplied to the developing apparatus in the pre-toner-supply operation. Then, the control part 90 determines the new toner amount to be further supplied, based on the obtained old toner amount and the new toner amount supplied to the developing apparatus in the pre-toner-supply operation. By thus obtaining the old toner amount in the developing apparatus in this method, it is possible to obtain the old toner amount in the developing apparatus precisely in comparison to the case where the remaining amount detecting part is used to detect the old toner amount in the developing apparatus.

In the present embodiment, by determining the new toner amount to be supplied in the pre-toner-supply operation such that the ratio of new toner amount with respect to all the toner amount in the developing apparatus after the pre-toner-supply operation becomes equal to or less than 30%, it is possible to obtain the ratio of new toner by using a range of the ratio of new toner in which range a relationship between the ratio of new toner in the developing apparatus and the fog amount varies in a monotonously decreasing (i.e., actually, increasing in the fog amount) manner as shown in FIG. 1. Thus, it is possible to obtain the precise ratio of new toner, and it is possible to obtain the old toner amount precisely.

Further, in the present embodiment, the new toner amount to be supplied in the pre-toner-supply operation may be determined based on the operational status of the developing apparatus. Specifically, in a case where the running distance (operational status) of the developing apparatus is short, the new toner amount to be supplied in the pre-toner-supply operation is made larger. Thereby, even when deterioration of the old toner in the developing apparatus is minor, it is possible to cause fog to a certain amount by means of the reflection optical sensor. As a result, it is possible to detect a fog amount with high precision, and it is possible to precisely obtain the old toner amount.

Further, in the present embodiment, the remaining amount detecting part (including the transmission optical sensor 81K in the example of the color K and the control part 90) that detects the toner remaining amount in the developing apparatus is provided, and when the remaining amount detecting part has detected that the toner amount in the developing apparatus has become equal to or less than the predetermined toner amount value, the toner supply amount is determined and the determined amount of toner is supplied to the developing apparatus. Thus, it is possible to start the process including and subsequent to step S2 of the toner supply control operation of FIG. 8 for supplying toner to the developing apparatus, when the toner in the developing apparatus has been reduced to a certain degree. Thereby, it is possible to cause a deterioration degree to become clearly different between the new toner to be supplied and the old toner remaining in the developing apparatus, and it is possible to obtain the old toner amount precisely. Further, it is possible to start the process including and subsequent to step S2 of the toner supply control operation of FIG. 8 for supplying toner to the developing apparatus, when the old toner remaining in the developing apparatus has been sufficiently reduced. Therefore, it is possible to reduce the new toner supply amount to be supplied, which is determined such that the ratio of new toner becomes such that fog becomes equal to or less (better) than the allowable level. Thereby, it is possible to prevent the toner amount in the developing apparatus after new toner is supplied from becoming much.

Further, in the present embodiment, such control may be carried out that in a case where the fog level is the allowable level and the remaining amount detecting part has detected that the toner amount in the developing apparatus after the pre-toner-supply operation exceeds the predetermined toner amount, determination of the new toner supply amount to be further supplied to the developing apparatus and supplying the thus-determined amount of new toner to the developing apparatus are not carried out. Thereby, it is possible to shorten the time period required for supplying toner to the developing apparatus, and shorten downtime of the developing apparatus.

Further, in the present embodiment, a blank paper image as a fog detecting image is formed before the pre-toner-supply operation, and the operational status of the developing apparatus from when toner was supplied to the developing apparatus the last time is obtained based on the detection result from the blank paper image obtained by the reflection optical sensor 150. As shown in FIG. 1, the fog amount obtained when the new toner is 0%, i.e., all of the toner in the developing apparatus is the old toner (i.e., at the left end of FIG. 1), varies for each of respective operational statuses of the developing apparatus. Therefore, by detecting fog obtained before new toner is supplied in the pre-toner-supply operation, it is possible to obtain the operational status of the developing apparatus.

Further, it is also possible to obtain the operational status of the developing apparatus from when toner was supplied to the developing apparatus the last time, based on the driving time period of the developing apparatus.

The present invention is not limited to the specifically disclosed embodiments, and variations and modifications may be made without departing from the scope of the present invention.

The present application is based on Japanese Priority Application No. 2010-049004, filed on Mar. 5, 2010, the entire contents of which are hereby incorporated herein by reference.

What is claimed is:

1. An image forming apparatus comprising:

a latent image carrying member that carries a latent image;

an electrifying part that electrifies a surface of the latent image carrying member;

a latent image writing part that writes the latent image on the latent image carrying member;

a developing part that develops the latent image on the latent image carrying member by using toner and obtains a toner image;

a transferring part that transfers the toner image on the latent image carrying member to a surface of an endless moving member in which the surface is moved in an endless manner or a recording member held on the surface of the endless moving member;

a toner container that holds new toner to be supplied to the developing part;

a toner supplying part that supplies the new toner held by the toner container to the developing part;

a fog detecting part that detects fog of an image; and a toner supply amount determining part that, prior to supplying the new toner to the developing part, carries out a pre-toner-supply operation of supplying a predetermined amount of the new toner to the developing part, forms a fog detecting image after the pre-toner supply operation, detects fog in the fog detecting image by using the fog detecting part, and determines a new toner supply amount to be supplied to the developing part based on a detection result obtained from the fog detecting part detecting fog in the fog detecting image and an operational status of the developing part since supplying the new toner to the developing part the last time, wherein the toner supplying part supplies the new toner supply amount of the new toner determined by the toner supply amount determining part to the old toner in the developing part, without ejecting the old toner in the developing part.

2. The image forming apparatus as claimed in claim 1, further comprising:

a storing part that stores characteristic information that indicates relationship for each operational status between fog and a ratio of new toner with respect to all the toner in the developing part, wherein the toner supply amount determining part determines the characteristic information corresponding to the operational status based on the operational status, determines an old toner amount in the developing part after the pre-toner-supply operation based on the determined characteristic information, the detection result obtained from the fog detecting image, and the predetermined amount of the new toner supplied at the time of the pre-toner-supply operation, and determines the new toner supply amount based on the determined old toner amount and the predetermined amount of the new toner supplied at the time of the pre-toner-supply operation.

3. The image forming apparatus as claimed in claim 2, wherein the predetermined amount of the new toner to be supplied in the pre-toner-supply operation is determined so that the ratio of new toner with respect to all the toner in the developing part becomes equal to or less than 30% after the pre-toner-supply operation.

4. The image forming apparatus as claimed in claim 1, wherein the predetermined amount of the new toner to be supplied in the pre-toner-supply operation is determined based on the operational status.

5. The image forming apparatus as claimed in claim 1, further comprising:

a remaining amount detecting part that detects a toner remaining amount in the developing part, wherein when the remaining amount detecting part has determined that the toner amount in the developing part is equal to or less than a predetermined toner amount, the toner supply amount determining part determines the new toner supply amount, and the toner supplying part supplies the new toner supply amount of the new toner determined by the toner supply amount determining part to the developing part.

6. The image forming apparatus as claimed in claim 5, wherein when fog detected by the fog detecting part is at an allowable level, and the remaining amount detecting part has detected that the toner amount in the developing part after the pre-toner-supply operation exceeds the predetermined toner amount, operations of the toner supply amount determining part determining the new toner supply amount and the toner supplying part supplying the new toner supply amount of the new toner determined by the toner supply amount determining part to the developing part are not carried out.

7. The image forming apparatus as claimed in claim 1, wherein before the pre-toner-supply operation, the fog detecting image is formed, the fog detecting part detects fog in the fog detecting image, and the operational status of the developing part since supplying the toner to the developing part the last time is determined based on a detection result of the fog detecting part detecting fog in the fog detecting image.

8. The image forming apparatus as claimed in claim 1, wherein the operational status of the developing part since supplying the toner to the developing part the last time is determined based on a driving time period of the developing part.

9. A toner supply method of supplying toner from a toner container to a developing part that causes the toner to adhere to a latent image formed on a latent image carrying member and develops the latent image, the method comprising:

carrying out a pre-toner-supply operation of supplying a predetermined amount of toner to the developing part;

forming a fog detecting image and detecting fog in the fog detecting image;

determining a toner supply amount to be supplied to the developing part based on the fog detected in the detecting and an operational status of the developing part since supplying the toner to the developing part the last time; and supplying the toner supply amount of the toner, determined in the determining step, to old toner in the developing part, without ejecting the old toner in the developing part.

10. An image forming apparatus comprising:

a latent image carrying member that carries a latent image;

an electrifying part that electrifies a surface of the latent image carrying member;

a latent image writing part that writes the latent image on the latent image carrying member;

a developing part that develops the latent image on the latent image carrying member by using toner and obtains a toner image;

a transferring part that transfers the toner image on the latent image carrying member to a surface of an endless moving member in which the surface is moved in an endless manner or a recording member held on the surface of the endless moving member;

a toner container that holds new toner to be supplied to the developing part;

a toner supplying part that supplies the new toner held by the toner container to the developing part;

a fog detecting part that detects fog of an image; and means for determining a toner supply amount to be supplied to the developing part prior to supplying the new toner to the developing part, by carrying out a pre-toner-supply operation of supplying a predetermined amount of the new toner to the developing part, forming a fog detecting image after the pre-toner supply operation, detecting fog in the fog detecting image by using the fog detecting part, and determining the new toner supply amount to be supplied to the developing part based on the detection result obtained from the fog detecting part detecting fog in the fog detecting image and an operational status of the developing part since supplying the new toner to the developing part the last time, wherein the toner supplying part supplies the new toner supply amount of the new toner determined by the means for determining a toner supply amount to the to old toner in the developing part, without ejecting the old toner in the developing part.

* * * * *